US007913967B1

(12) United States Patent
Aleo

(10) Patent No.: US 7,913,967 B1
(45) Date of Patent: Mar. 29, 2011

(54) ADJUSTABLE PICTURE-HANGER ASSEMBLY

(76) Inventor: Dino D. Aleo, Windsor (CA)

( * ) Notice: Subject to any disclaimer, the term of this patent is extended or adjusted under 35 U.S.C. 154(b) by 0 days.

(21) Appl. No.: 12/616,425

(22) Filed: Nov. 11, 2009

(51) Int. Cl.
*A47G 1/24* (2006.01)

(52) U.S. Cl. ..... 248/476; 248/495

(58) Field of Classification Search ..... 248/476, 248/544, 466, 475.1, 495, 323
See application file for complete search history.

(56) References Cited

U.S. PATENT DOCUMENTS 3,330,525 A * 7/1967 Weinstein ..... 248/496
6,572,067 B1 * 6/2003 Kamenstein et al. ..... 248/476
6,666,425 B1 * 12/2003 Ferguson ..... 248/477
7,201,357 B2 * 4/2007 Price et al. ..... 248/477
7,654,500 B1 * 2/2010 Jump ..... 248/476
2010/0116964 A1 * 5/2010 Aleo ..... 248/476

* cited by examiner

*Primary Examiner* — Anita M King
(74) *Attorney, Agent, or Firm* — Bliss McGlynn, P.C.

(57) ABSTRACT

An adjustable picture-hanger assembly comprises a hanger adapted to be secured to a wall and defining a substantially central opening of an interior of the hanger. A hanger slide is movably mounted to the hanger, is adapted to slide continuously substantially rotationally in the opening of the hanger, and defines a slot of an interior of the hanger slide. A mounting fastener is received through the slot of the hanger slide and adapted to slide continuously along the slot and be fastened to the wall to mount the assembly to the wall. A combination of the continuous substantially rotational sliding of the hanger slide and continuous sliding of the mounting fastener allows for substantially infinite placement of the mounting fastener in the opening of the hanger. A hanger hook is fixedly connected to and extends outwardly from the hanger and overlies the opening of the hanger for supporting an object hung on the hanger hook.

18 Claims, 1 Drawing Sheet

ADJUSTABLE PICTURE-HANGER ASSEMBLY

BACKGROUND OF INVENTION

1. Field of Invention

The invention relates, generally, to a picture hanger and, more particularly, to such a hanger that is adjustable.

2. Description of Related Art

Various adjustable picture hangers are known. Each such hanger generally is adapted to be attached to a surface of a vertical wall for adjustably hanging or suspending wall décor—such as pictures, photographs, paintings, mirrors, collectibles, calendars, and corresponding frames—on the wall surface.

For example, U.S. Pat. No. 7,201,357 discloses a vertically adjustable wall hanger that comprises a hanger and a hanger mount. The hanger includes a main hanger body, a first set of serrations defined in side-to-side spaced relation to one another on a back side of the main hanger body, and a center slot defined and a hanging hook provided on the main hanger body. The hanger mount includes a main mount body having a second set of serrations defined on a body face positioned in side-to-side spaced relation and sized and shaped similar to and confronting the first set of serrations. The second set of serrations is located on a back side of the main mount body with the main mount body defining a screw hole confronting the center slot on the main hanger body. A center hanger mount is held in the main mount body positioned in co-axial alignment with the center slot provided in the main hanger body. The hanger and hanger mount are assembled together by meshing the respective serrations in the first and second sets of serrations in a pre-selected position to accommodate corresponding positioning requirements of a user of the device. A mounting screw extends through the main hanger body and center hanger mount in clamped abutting assembly with each other to hold the hanger and hanger mount in superimposed lapped engagement with each other in the pre-selected position.

Also, U.S. Pat. No. 6,666,425 discloses a vertically adjustable wall hanger comprising a main body—which is securable to a vertical surface with mounting screws, nails, or other similar fasteners—and an adjustable bracket. The main body defines a pair of mounting apertures and is generally symmetrical about a plane passing through axes defined by the mounting apertures. The main body also includes a vertically oriented linear ratchet having a plurality of teeth and a pair of parallel, outwardly-facing, spaced-apart peripheral tracks or grooves. Each of the tracks is open at a top of the main body. The adjustable bracket includes a pair of cylindrical locator pins that enter the tracks at the top of the main body and slide within them. The adjustable bracket includes also a pawl that engages the linear ratchet. The locator pins allow the adjustable bracket to be rotated upwardly so that the pawl may be disengaged from the linear ratchet, the adjustable bracket moved up or down, and the pawl re-engaged with the linear ratchet.

However, these and other of the known adjustable picture hangers do not perfectly place/align the wall décor or corresponding frame on the wall surface. More specifically, they do not adjust in more than two ways to accommodate imperfections of the wall décor or corresponding frame and/or construction of the wall surface. They do not adjust in also a continuous manner. Rather, they adjust in a discrete, incremental manner.

Thus, there is a need in the related art for an adjustable picture hanger that perfectly places/aligns the wall décor or corresponding frame on the wall surface. More specifically, there is a need in the related art for a picture hanger that adjusts in more than two ways to accommodate imperfections of the wall decor or corresponding frame and/or construction of the wall surface. There is a need in the related art for a picture hanger that adjusts in also a continuous—rather than a discrete, incremental—manner.

SUMMARY OF INVENTION

The invention overcomes the problems in the related art in an adjustable picture-hanger assembly comprising a hanger adapted to be secured to a wall and defining a substantially central opening of an interior of the hanger. A hanger slide is movably mounted to the hanger, is adapted to slide continuously substantially rotationally in the opening of the hanger, and defines a substantially linear slot of an interior of the hanger slide. A mounting fastener is received through the slot of the hanger slide and adapted to slide continuously along the slot and be fastened to the wall to mount the assembly to the wall. A combination of the continuous substantially rotational sliding of the hanger slide and continuous substantially linear sliding of the mounting fastener allows for substantially infinite placement of the mounting fastener in the opening of the hanger. A hanger hook is fixedly connected to and extends outwardly from the hanger and overlies the opening of the hanger for supporting an object hung on the hanger hook.

An advantage of the adjustable picture-hanger assembly of the invention is that it perfectly places/aligns the object—such as a picture, photograph, painting, mirror, collectible, calendar, or corresponding frame—on the wall.

Another advantage of the adjustable picture-hanger assembly of the invention is that it adjusts in more than two ways (substantially linearly in combination with 360-degree adjustability) to accommodate imperfections of the picture, photograph, painting, mirror, collectible, calendar, or corresponding frame and/or construction of the wall.

Another advantage of the adjustable picture-hanger assembly of the invention is that it adjusts in a continuous—rather than a discrete, incremental—manner.

Another advantage of the adjustable picture-hanger assembly of the invention is that it can be manufactured simply and inexpensively and in high volume using low-cost materials—such as high-performance thermoplastic—and processes—such as injection molding.

Another advantage of the adjustable picture-hanger assembly of the invention is that it can be easily operated by a person who needs to make a quick and accurate placement of the picture, photograph, painting, mirror, collectible, calendar, or corresponding frame (especially a group of same) on an indoor or outdoor wall of a building with a minimum of difficulty.

Another advantage of the adjustable picture-hanger assembly of the invention is that it is reusable, versatile, recyclable, and eco-friendly.

Another advantage of the adjustable picture-hanger assembly of the invention is that it can be universally used—such as in residential and commercial applications; on an object utilizing a wire-, keyhole-, d-ring-, sawtooth-, step-, or general-hole application; and on drywall with or without use of a stud.

Another advantage of the adjustable picture-hanger assembly of the invention is that it has a robust design, with some parts thereof able to be made of aluminum and/or steel, and is virtually unbreakable.

Other objects, features, and advantages of the adjustable picture-hanger assembly of the invention will be readily appreciated as the same becomes better understood while reading the subsequent detailed description of an embodiment of the assembly taken in conjunction with the accompanying drawing of such embodiment.

BRIEF DESCRIPTION OF EACH FIGURE OF DRAWING

DETAILED DESCRIPTION OF EMBODIMENT OF INVENTION

Figure 1:
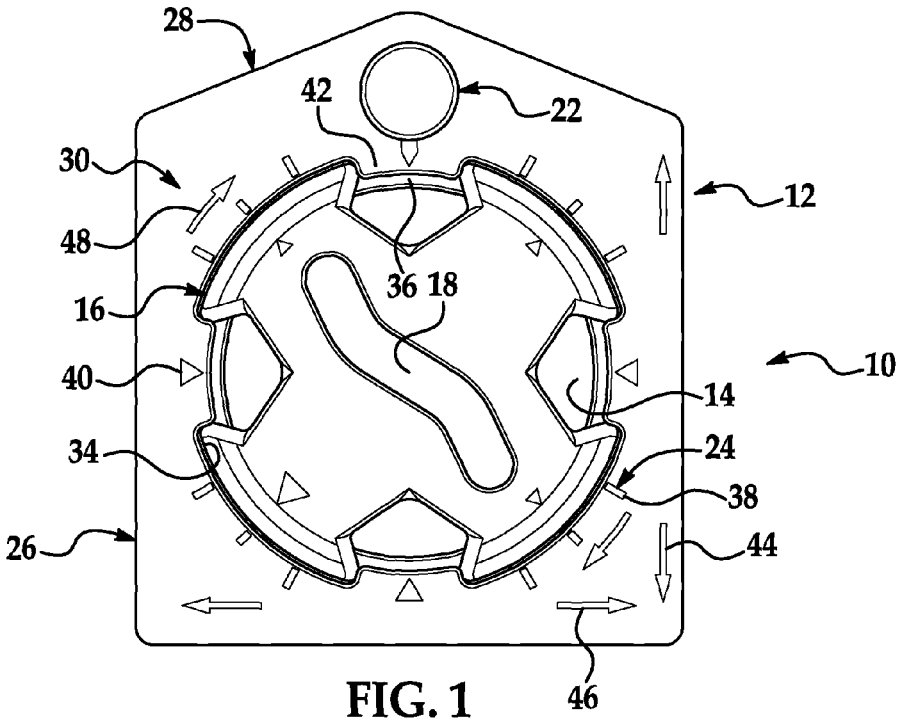
FIG. 1 is an elevated top view of an embodiment of an adjustable picture-hanger assembly according to the invention without the mounting fastener received through the slot of the hanger slide of the assembly.
Figure 2:
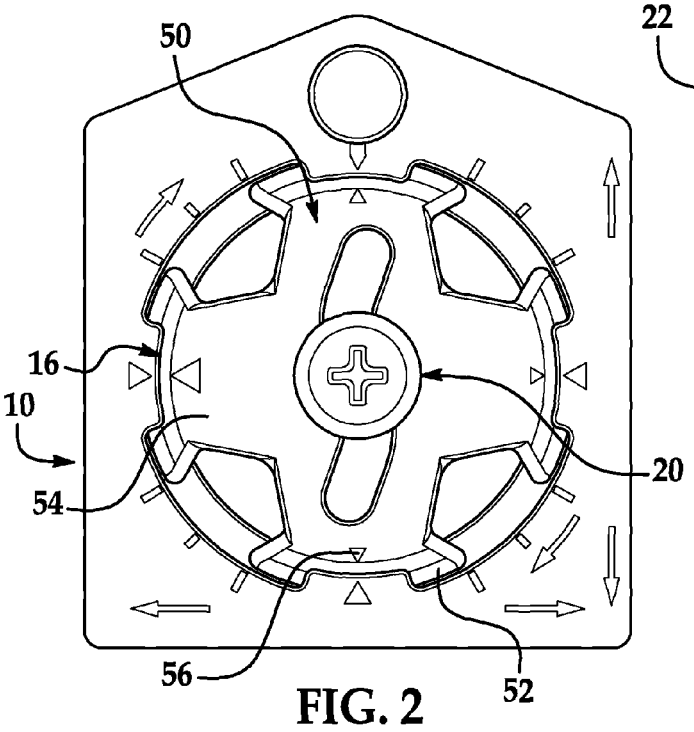
FIG. 2 is an elevated top view of the embodiment of the adjustable picture-hanger assembly according to the invention shown in FIG. 1 with the mounting fastener received through the slot of the hanger slide of the assembly.
Figure 3:
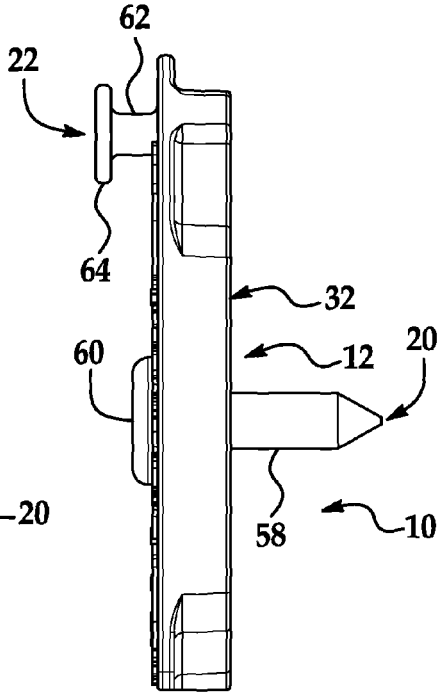
FIG. 3 is an elevated side view of the embodiment of the adjustable picture-hanger assembly according to the invention shown in FIG. 1 with the mounting fastener received through the slot of the hanger slide of the assembly.

An assembly for adjustably hanging an object to a wall according to the invention is generally indicated at 10 in FIGS. 1 through 3, where like numerals are used to designate like structure throughout the embodiment of the assembly 10 disclosed herein. Although the assembly 10 is designed to be attached to a vertical wall for adjustably hanging or suspending wall décor—such as a picture, photograph, painting, mirror, collectible, calendar, or corresponding frame—on a surface of the wall, the assembly 10 is described below for adjustably hanging or suspending specifically a picture frame.

It should be appreciated by those having ordinary skill in the related art that the wall can have any suitable shape, size, structure, and texture and structural relationship with the assembly 10. It should be so appreciated also that the wall can be made of any suitable material—such as plaster and wood. It should be so appreciated also that the assembly 10 can be employed with a wall of any suitable structure. It should be so appreciated also that the assembly 10 can adjustably hang or suspend any suitable objects and not just those identified above. Details of the assembly 10 are described below with reference to the figures.

Now with reference particularly to FIGS. 1-2, the assembly 10 comprises, in general, a hanger, generally indicated at 12, adapted to be secured to the wall (not shown) and defining a substantially central opening 14 of an interior of the hanger 12. A hanger slide, generally indicated at 16, is mounted to the hanger 12, is adapted to slide continuously substantially rotationally in the opening 14 of the hanger 12, and defines a substantially linear slot 18 of an interior of the hanger slide 16. A mounting fastener, generally indicated at 20, is received through the slot 18 of the hanger slide 16 and adapted to slide continuously along the slot 18 and be fastened to the wall to mount the assembly 10 to the wall. A combination of the continuous substantial rotational sliding of the hanger slide 16 and continuous substantial linear sliding of the mounting fastener 20 allows for substantial infinite placement of the mounting fastener 20 in the opening 14 of the hanger 12. A hanger hook, generally indicated at 22, is fixedly connected to and extends outwardly from the hanger 12 and overlies the opening 14 of the hanger 12 for supporting the picture frame (not shown) hung on the hanger hook 22.

More specifically and as described in greater detail below, the hanger 12 defines also at least one distance scale, generally indicated at 24. FIGS. 1-2 show the hanger slide 16 being adapted to slide continuously substantially clockwise and counterclockwise in the opening 14 of the hanger 12. The slot 18 of the hanger slide 16 extends in a slight serpentine manner. (This slight deviation from linear is designed to provide more and better operative securement of the mounting fastener 20 to the hanger slide 16.) The combination of the continuous substantially clockwise and counterclockwise sliding of the hanger slide 16 and continuous slight serpentine sliding of the mounting fastener 20 allows for the substantially infinite placement of the mounting fastener 20 in the opening 14 of the hanger 12.

As shown in FIGS. 1-3, the hanger 12 includes a body section, generally indicated at 26, defining a substantially square cross-section of the body section 26 and an upper section, generally indicated at 28, defining a substantially triangular cross-section of the upper section 28 (with respect to a plane defined by the page of FIGS. 1-2). The upper section 28 is substantially flush with and integrally extends from a top edge of the body section 26. The hanger 12 includes also a top level, generally indicated at 30, and a bottom level, generally indicated at 32, that are substantially opposed and spaced from each other. The levels 30, 32 are connected with each other interiorly along a substantially uniform wall surface 34 defined between the levels 30, 32. The bottom level 32 of the body section 26 defines a substantially uniform ledge 36 extending radially inward into the opening 14 from a bottom of an entirety of the wall surface 34. The ledge 36 is adapted to support a bottom surface of the hanger slide 16 such that the hanger slide 16 can slide continuously substantially rotationally in the opening 14. The levels 30, 32 are connected with each other exteriorly along at least a closed exterior edge or at least one corner defined by the body section 26. FIG. 3 shows the levels 30, 32 being connected with each other along a plurality of closed exterior edges 36 and bottom corners defined by the body section 26.

The opening 14 of the hanger 12 defines a substantially circular cross-section (with respect to a plane defined by the page of FIGS. 1-2) of the opening 14 and is defined substantially symmetrically in a substantially central volume of the body section 26 of the hanger 12 such that the wall surface 34 completely outlines the opening 14. A single distance scale 24 is identified by four series of hash marks 38 and located substantially completely and immediately about the opening 14 on the top level 30. The series of hash marks 38 are disposed substantially equidistant with each other. Four pointers 40 are located about the opening 14 between and substantially in alignment with adjacent series of hash marks 38. In this way, the body section 26 defines essentially a "clock," wherein the pointers 40 point radially inward toward a center of the opening 14 and respectively represent "12," "3," "6," and "9" o'clock. The body section 26 defines an overhang 42 located at (and to immediate circumferential sides of) each of the pointers 40, projecting slightly over the opening 14, and adapted to movably mount the hanger slide 16 to the hanger 12. A side area of the top level 30 includes arrows 44 indicating corresponding "up" and "down" directions along the side area, a bottom area of the top level 30 includes arrows 46 indicating corresponding "right" and "left" directions along the bottom area, and arrows 48 are disposed on the top level 30 outside the hash marks 38 and indicate a "clockwise" direction about the opening 14. Each of the corners of the hanger 12 is arcuate.

It should be appreciated by those having ordinary skill in the related art that the hanger 12, in general, can have any suitable shape, size, and structure. It should be so appreciated also that the opening 14 can have any suitable shape and size and structural relationship with the remainder of the hanger 12. It should be so appreciated also that each of the sections 26, 28 and levels 30, 32 can have any suitable shape, size, and structure and structural relationship with the remainder of the hanger 12. It should be so appreciated also that the sections 26, 28 and levels 30, 32 can be connected with each other in any suitable manner. It should be so appreciated also that the distance scale 24 can use any suitable units—such as millimeters, centimeters, and/or inches—and have any suitable relationship with the remainder of the top level 30. It should be so appreciated also that each of the wall surface 34, ledge 36, and overhangs 42 can have any suitable shape, size, and structure and structural relationship with the remainder of the top level 28. It should be so appreciated also that each of the hash marks 38, pointers 40, and arrows 44, 46, 48 can have any suitable shape and size and structural relationship with the remainder of the top level 28.

The hanger slide 16 defines a substantially "four-trunk star" cross-section (with respect to a plane defined by the page of FIGS. 1-2) and is slightly convex relative to the top level 30 of the hanger 12. This design provides structural integrity to the hanger slide 16. Each of four trunks, generally indicated at 50, of the hanger slide 16 tapers radially outward from a substantially central portion of the hanger slide 16 to a free end 52 of the trunk 50. The free end 52 defines a circumferential-arc portion of the trunk 50 that is greater in length than a width of a base 54 of the trunk 50 and substantially a same length as a circumferential-arc length defined between adjacent overhangs 42 of the hanger 12. In this way, the free ends 52 are adapted to be snap-fitted between corresponding adjacent overhangs 42 into the opening 14 of the hanger 12. Upon such fitting, the hanger slide 16 is supported upon the ledge 36 of the hanger 12, substantially abuts the wall surface 34 of the hanger 12, and is able to rotate clockwise and counterclockwise continuously and smoothly within the opening 14 sufficiently closely between the overhangs 42 and ledge 36. When the hanger slide 16 is so supported, an arrow 56 located on each free end 52 (pointing radially outward away from the center of the opening 14) points toward and can be aligned with certain of the hash marks 38 and/or pointers 40 of the hanger 12. The length of the circumferential-arc portion of each free end 52 is substantially greater than that of each overhang 42. Space is defined between adjacent trunks 50 such that the hanger slide 16 is substantially symmetrical. A diameter of the hanger slide 16 is slightly less than a length of each side of the body section 26 of the hanger 12.

The slot 18 of the hanger slide 16 defines a slightly serpentine cross-section (with respect to a plane defined by the page of FIGS. 1 and 2), is defined completely through a depth of the hanger slide 16, and extends substantially asymmetrically from an interior side of the free end 52 of a trunk 50 through the center of the hanger slide 16 to an interior side of the free end 52 of an opposite trunk 50. In particular, the slot 18 defines essentially three substantially linear parts and a substantially arcuate part disposed between adjacent linear parts. A width of each trunk 50 of the hanger slide 16 is significantly greater than that of the slot 18. Relative to the center of the slot 18, a half of the slot 18 is substantially the inverse of the other half of the slot 18.

It should be appreciated by those having ordinary skill in the related art that the hanger slide 16, in general, can have any suitable shape, size, and structure and structural relationship with the hanger 12. It should be so appreciated also that the slot 18 can have any suitable shape and size and structural relationship with the remainder of the hanger slide 16. It should be so appreciated also that the hanger slide 16 can be fitted into the opening 14, supported by the hanger 12, and rotated within the opening 14 in any suitable manner.

The mounting fastener 20 includes an assembly of a screw, generally indicated at 58, and an optional anchor (not shown). The screw 58 is adapted to be inserted completely through the slot 18 of the hanger slide 16 from above the hanger slide 16 and screwed into the wall to mount the assembly 10 to the wall. An outer diameter defined by a head 60 of the screw is greater than a width defined by the slot 18. As such, the head 60 operatively contacts an upper surface of the hanger slide 16 and maintains the head 60 above the hanger slide 16. The mounting fastener 20 is adapted to slide continuously and smoothly in the slot 18 from an end of the slot 18 to the other end of the slot 18.

It should be appreciated by those having ordinary skill in the related art that the mounting fastener 20, in general, can have any suitable shape, size, and structure and structural relationship with the hanger slide 16. It should be so appreciated also that each of the screw 58 (including the head 60) can have any suitable shape, size, and structure and structural relationship with the remainder of the mounting fastener 20. It should be so appreciated also that the mounting fastener 20 can be any suitable fastener adapted to mount the assembly 10 to the wall. It should be so appreciated also that the mounting fastener 20 can slide in any suitable manner for any suitable distance. It should be so appreciated also that the anchor can be used if no stud is found in the wall into which the screw 58 is to be inserted. Otherwise, the screw 58 can be used directly without use of the anchor.

As shown in FIG. 3, the hanger hook 22 includes a stem portion 62 and a head portion 64 integrally disposed atop the stem portion 62. The stem portion 62 extends integrally outwardly a desired distance from a substantially central portion of the upper section 28 of the hanger 12, and the head portion 64 is adapted to support the picture frame hung on the hanger hook 22. When the assembly 10 is mounted to the wall, a substantially upper half of the stem portion 62 is adapted to operatively receive a part, say, a string or wire that is secured to the picture frame and used to hang the picture frame upon the assembly 10. The head portion 64 operates to retain the string or wire on the stem portion 62.

It should be appreciated by those having ordinary skill in the related art that the hanger hook 22, in general, can have any suitable shape, size, and structure and structural relationship with the hanger 12. It should be so appreciated also that each of the stem portion 62 and head portion 64 can have any suitable shape, size, and structure and structural relationship with the other. It should be so appreciated also that the stem portion 62 can extend any suitable distance from the hanger 12.

When it is desired to use the assembly 10, the user of the assembly 10 should determine where the picture frame to be hung is to be located on a surface of the wall. Although the assembly 10 can be used to hang a single picture frame, the assembly 10 is specially designed to be used to hang a plurality of picture frames in a pre-designed arrangement on the wall surface.

To this end, a location on the surface of the wall must be first chosen. Then, the picture frame is laid out on the wall, a desired spot is chosen, and a reference point is (or reference points are) marked with, say, a pencil. Then, an insertion point is marked with the pencil about one inch vertically below the reference point(s) to install the anchor (if a stud is not found in the wall immediately behind the reference and insertion points). (This allows use of maximum adjustability range of the hanger 12 in an upright position thereof). Then, the anchor is placed in position, tapped and screwed (by placing, say, a "Phillips" screwdriver into a recess of the anchor and turning clockwise until the anchor is flush with the surface of the wall). Then, the hanger 12 is placed in position over the anchor, and, as described in detail below, the screw 58 is inserted and attached using the screwdriver. It should be noted that no drilling is needed.

Of course, if a stud is found in the wall immediately behind the reference and insertion points, the screw 58 is used directly. The screw 58 is inserted through the slot 18 of the hanger slide 16 in such a way that the head 60 is loosely positioned upon the hanger slide 16. At this point, a judgment is made about where the mounting fastener 20 is to be specifically located relative to the opening 14. Thereafter, the assembly 10 is adjusted by sliding the hanger 12 to the desired position with the hanger hook 22 being the hanging point, and the screw 58 is tightened to secure the assembly 10 to the wall. More specifically, the mounting fastener 20 quickly and simply is manually slid in the slot 18 and/or the hanger slide 16 is manually slid in the opening 14 until the mounting fastener 20 is moved to the specific location. The distance scale 24, pointers 40, and arrows 56 can be used to assist in pinpointing this location. Then, the screw 58 is set into the wall to mount the assembly 10 to the wall. Finally, the picture frame is hung upon the hanger hook 22. In this way, the mounting fastener 20 is adjustable along both x- and y-directions and 360° to provide perfect alignment/placement of the picture frame on the surface of the wall. Once the picture frame is hung, it is adjusted if necessary for perfect placement thereof, properly secured, and verified.

As can easily be seen, use of the assembly 10 provides continuous adjustability of the picture frame in more than two directions and permits leveling, raising, or lowering of the picture frame from less than a millimeter to greater than fifty millimeters and perfect placement of the picture frame on the surface of the wall. Furthermore, the assembly 10 can accommodate wire, serrated metal clips, slotted holes, plates, and/or eyelets of the picture frame in any configuration. Moreover, the hanger hook 22 is designed for universal use.

Preferably, each component of the assembly 10 is made of high-performance thermoplastic. Some parts of the assembly 10, such as the hanger slide 16, can even be made of aluminum and/or steel. Also preferably, each component of the assembly 10 is made using injection-molding processes. Furthermore, design of the assembly 10 can be modified to provide increased capacity (holding strength) and range of adjustability of the assembly 10—including increasing thickness (depth), width, length, diameter of the opening 14, and/or size of the mounting fastener 20 and/or changing material of the assembly 10. In addition, although the assembly 10 is primarily used for interior applications, the assembly 10 can be used for exterior applications as well.

The assembly 10 perfectly places/aligns the picture frame on the wall. Also, the assembly 10 adjusts in more than two ways (substantially linearly in combination with 360-degree adjustability) to accommodate imperfections of the picture frame and/or construction of the wall. And, the assembly 10 adjusts in a continuous—rather than a discrete, incremental—manner. Furthermore, the assembly 10 can be manufactured simply and inexpensively and in high volume using low-cost materials—such as high-performance thermoplastic—and processes—such as injection molding. In addition, the assembly 10 can be easily operated by a person who needs to make a quick and accurate placement of the picture frame (especially a group of same) on an indoor or outdoor wall of a building with a minimum of difficulty. Moreover, the assembly 10 is reusable, versatile, recyclable, and eco-friendly. Plus, the assembly 10 can be universally used—such as in residential and commercial applications; on a picture frame utilizing a wire-, keyhole-, d-ring-, sawtooth-, step-, or general-hole application; and on drywall with or without use of a stud. The assembly 10 has a robust design, with some parts thereof able to be made of aluminum and/or steel, and is virtually unbreakable as well.

The assembly 10 has been described herein in an illustrative manner. It is to be understood that the terminology that has been used herein is intended to be in the nature of words of description rather than of limitation. Many modifications and variations of the assembly 10 are possible in light of the above teachings. Therefore, within the scope of the appended claims, the assembly 10 may be practiced other than as specifically described herein.

What is claimed is:

1. An adjustable picture-hanger assembly comprising:

a hanger adapted to be secured to a wall and defining a substantially central opening of an interior of said hanger;

a hanger slide movably mounted to said hanger, adapted to slide continuously substantially rotationally in said opening of said hanger, and defining a slot of an interior of said hanger slide;

a mounting fastener received through said slot of said hanger slide and adapted to slide continuously along said slot and be fastened to the wall to mount said assembly to the wall, wherein a combination of the continuous substantially rotational sliding of said hanger slide and continuous sliding of said mounting fastener allows for substantially infinite placement of said mounting fastener in said opening of said hanger; and a hanger hook fixedly connected to and extending outwardly from said hanger and overlying said opening of said hanger for supporting an object hung on said hanger hook.

2. An adjustable picture-hanger assembly as set forth in claim 1, wherein said hanger includes a body section and an upper section extending from said body section.

3. An adjustable picture-hanger assembly as set forth in claim 2, wherein said hanger includes also a top level and a bottom level that are substantially opposed and spaced from each other and said levels are connected with each other interiorly along a wall surface defined between said levels.

4. An adjustable picture-hanger assembly as set forth in claim 3, wherein said bottom level of said body section defines a ledge extending radially inward into said opening from said body section and adapted to support said hanger slide such that said hanger slide can slide continuously substantially rotationally in said opening.

5. An adjustable picture-hanger assembly as set forth in claim 3, wherein said opening of said hanger is defined in said body section such that said wall surface outlines said opening.

6. An adjustable picture-hanger assembly as set forth in claim 1, wherein said assembly further comprises at least one distance scale.

7. An adjustable picture-hanger assembly as set forth in claim 4, wherein said body section of said hanger defines a plurality of overhangs projecting over said opening and adapted to movably mount said hanger slide to said hanger.

8. An adjustable picture-hanger assembly as set forth in claim 7, wherein said hanger slide defines a substantially "multi-trunk star" cross-section, wherein each of a plurality of trunks of said hanger slide extends radially outward from a substantially central portion of said hanger slide to a free end of said trunk.

9. An adjustable picture-hanger assembly as set forth in claim 8, wherein said free end of each of said trunks defines a circumferential-arc portion of said trunk that is substantially a same length as a circumferential-arc length defined between adjacent of said overhangs of said hanger such that said free ends are adapted to be snap-fitted between corresponding said adjacent overhangs into said opening of said hanger.

10. An adjustable picture-hanger assembly as set forth in claim 7, wherein said hanger slide operatively is supported upon said ledge of said hanger, substantially abuts said wall surface of said hanger 12, and is able to rotate clockwise and counterclockwise continuously and smoothly within said opening between said overhangs and ledge.

11. An adjustable picture-hanger assembly as set forth in claim 1, wherein said slot of said hanger slide defines a slightly serpentine cross-section and is defined completely through a depth of said hanger slide.

12. An adjustable picture-hanger assembly as set forth in claim 8, wherein said slot of said hanger slide extends from said free end of one of said trunks to said free end of an opposite of said trunks.

13. An adjustable picture-hanger assembly as set forth in claim 1, wherein said mounting fastener includes a screw adapted to be inserted completely through said slot of said hanger slide from above said hanger slide and screwed into the wall to mount said assembly to the wall.

14. An adjustable picture-hanger assembly as set forth in claim 13, wherein an outer diameter defined by a head of said screw is greater than a width defined by said slot of said hanger slide such that said head operatively contacts an upper surface of said hanger slide and maintains said head above said hanger slide and said mounting fastener is adapted to slide continuously and smoothly in said slot from an end of said slot to another end of said slot.

15. An adjustable picture-hanger assembly as set forth in claim 1, wherein said hanger hook includes a stem portion and a head portion disposed atop said stem portion, said stem portion extends outwardly a desired distance from said upper section of said hanger, and said head portion is adapted to support the object hung on said hanger hook.

16. An adjustable picture-hanger assembly as set forth in claim 1, wherein said assembly is made of high-performance thermoplastic.

17. An adjustable picture-hanger assembly as set forth in claim 1, wherein said hanger slide is made of at least one of aluminum and steel.

18. An adjustable picture-hanger assembly as set forth in claim 1, wherein said assembly is made using injection-molding processes.

* * * * *